US011825951B2

(12) United States Patent
Teleshevsky

(10) Patent No.: US 11,825,951 B2
(45) Date of Patent: Nov. 28, 2023

(54) MAGNETIC BEDDING SYSTEM WITH ZIPPERED ACCESS

(71) Applicant: Levi Teleshevsky, Brooklyn, NY (US)

(72) Inventor: Levi Teleshevsky, Brooklyn, NY (US)

( * ) Notice: Subject to any disclaimer, the term of this patent is extended or adjusted under 35 U.S.C. 154(b) by 0 days.

(21) Appl. No.: 17/351,367

(22) Filed: Jun. 18, 2021

(65) Prior Publication Data

US 2022/0400869 A1 Dec. 22, 2022

(51) Int. Cl.

| | |
|---|---|
| ***A47C 21/02*** | (2006.01) |
| ***A47G 9/02*** | (2006.01) |
| ***A47G 9/00*** | (2006.01) |

(52) U.S. Cl.

CPC ..... *A47C 21/022* (2013.01); *A47G 9/0223* (2013.01); *A47G 9/0246* (2013.01); *A47G 9/0261* (2013.01); *A47G 2009/004* (2013.01)

(58) Field of Classification Search

CPC ... A47C 21/022; A47C 31/003; A47C 27/002; A47C 21/028; A47C 31/105; A47G 9/0223; A47G 9/0246; A47G 9/0261; A47G 2009/004; A47G 2009/0276; A47G 9/04; A47G 9/0292; A47G 9/0284; A47G 9/0238; A47G 9/02; A47G 2009/0269; A47G 9/0207; A47D 15/02; Y10T 24/32

See application file for complete search history.

(56) References Cited

U.S. PATENT DOCUMENTS

| | | | | |
|---|---|---|---|---|
| 6,032,308 | A | 3/2000 | Chuang | |
| 8,464,377 | B1 | 6/2013 | Carson | |
| 9,949,583 | B2 | 4/2018 | Reuben | |
| 10,881,225 | B1 | 1/2021 | Bernick | |
| 11,071,395 | B1 * | 7/2021 | Sopher | A47C 21/022 |
| 2016/0081497 | A1 * | 3/2016 | Keinigs | A47G 9/0246 24/381 |

* cited by examiner

*Primary Examiner* — Justin C Mikowski
*Assistant Examiner* — Madison Emanski
(74) *Attorney, Agent, or Firm* — KaiderLaw; Brian D. Kaider

(57) ABSTRACT

The present invention is a bedding system that simultaneously: 1) simplifies the process of installing a fitted sheet; 2) simplifies the process of removing and reinserting a duvet from a duvet cover; 3) secures a duvet inside the cover so it does not shift, bunch, or fold inside the cover; and 4) allows a user to quickly and easily to make a bed with all parts neatly aligned. The system comprises: a fitted sheet with zippers, a duvet, a duvet cover, and optionally a flat sheet. The invention further comprises a plurality of magnets and/or thin ferrous metal plates that secure a duvet inside the cover such that it does not shift, bunch, or fold inside the cover and align the duvet cover with the fitted sheet.

9 Claims, 8 Drawing Sheets

MAGNETIC BEDDING SYSTEM WITH ZIPPERED ACCESS

FIELD OF THE INVENTION

This invention relates to bedding systems, including fitted sheets, flat sheets, duvets, and duvet covers.

BACKGROUND OF THE INVENTION

A typical set of bedding includes a fitted sheet that is stretched over a mattress, a flat sheet tucked under the foot end of the mattress, and a blanket, comforter, or duvet on top, which may or may not be tucked under the foot end of the mattress. For the sake of simplicity, the term "duvet" is used herein to refer to blankets, comforters, quilts, duvets, bed spreads, or any other top layer of a bedding set. In some cases, the duvet may be removably inserted into a cover, referred to here as a duvet cover.

Several design features of the typical bedding set can lead to frustration. The fitted sheet can be difficult to stretch over the mattress by a single person, with one corner becoming loose or sliding off the mattress as an opposite corner is stretched, often requiring the person to go back and forth to stretch each corner several times. As a user moves around during sleep, they can often pull the flat sheet out from under the mattress, causing it to bunch up around the feet or be pulled to one side of the bed. Likewise, the duvet can be pulled out of place and bunch up or be pulled to one side of the bed.

When a duvet cover is used, the duvet may move around inside the cover, bunching up in some portions resulting in a lumpy appearance and feel with thicker cover in some areas and thinner in others. To wash the duvet cover, the user generally must remove the duvet from the cover. Duvet covers are often sealed on three sides, by stitching or other means, with one side either left open or at least partially closable with buttons, snaps, zippers, hook and loop fasteners, or other known means. Given the size and thickness of the duvet, removing it from the cover can be difficult and reinserting it once the duvet cover is washed and dried can be even more challenging as it tends to bunch up and fold over itself, leading to a lumpy configuration that is thicker in some areas and thinner in others.

It can be difficult for one person to quickly and neatly change the sheets and/or make a bed, particularly for larger beds. Often it is difficult to center the flat sheet and/or the duvet on the bed and align all of the layers in an attractive fashion. These difficulties result in users not making their beds and/or not changing their sheets as often as they should.

Others have attempted to solve some of these problems. U.S. Pat. No. 6,032,308 teaches a duvet cover that has a U-shaped zippered opening allowing a user to insert the duvet. The zippered opening does not extend to the edges of the duvet cover, so the user still must stuff the duvet into the corners and edges of the cover. The reference also teaches the use of buttons on the inside corners of the cover and loops on the corners of the duvet, to secure the corners in place. U.S. Pat. No. 8,464,377 teaches separate magnetic "hubs" one of which is placed on one side of a duvet cover and another on the other side of the cover. Together, the hubs "clamp" the duvet inside the cover. One of the hubs may be placed on the inside of the fitted sheet, to clamp all the layers in place. U.S. Pat. No. 9,949,583 teaches a duvet cover with a slit in one side to insert the duvet and fastening means along the inside periphery of the cover, to engage with complementary fastening means along the periphery of the duvet. With an opening in just one side of the cover, the problem of inserting the duvet into the cover without bunching not only remains, but is exacerbated by the challenge of engaging the fastening means insider the cover on the far side from the opening. U.S. Pat. No. 10,881,225 teaches a duvet cover that opens like a book and has fastening means in each corner to hold the duvet in place. The open sides of the cover are then zipped on two sides with the third side having a "hood" that folds over the third open side to enclose the duvet.

SUMMARY OF THE INVENTION

While each of the references disclosed above have addressed one or more problems, with varying success, there is a need for a bedding system that simultaneously: 1) simplifies the process of installing a fitted sheet; 2) simplifies the process of removing and reinserting a duvet from a duvet cover; 3) secures a duvet inside the cover so it does not shift, bunch, or fold inside the cover; and 4) allows a user to quickly and easily to make a bed with all of the parts neatly aligned.

The present invention is a new magnetic bedding system that comprises: a fitted sheet with zippers, a duvet, a duvet cover, and optionally a flat sheet. The invention further comprises a plurality of magnets that secure a duvet inside the cover such that it does not shift, bunch, or fold inside the cover. The invention further comprises a plurality of magnets that align the duvet cover with the fitted sheet. The invention may also comprise a plurality of thin ferrous metal plates suitable to engage with the magnets of the invention.

These and other objects, advantages, and features of the invention are set forth in the detailed description, which follows.

DETAILED DESCRIPTION OF THE INVENTION

The following description includes exemplary embodiments of the invention. This description is not to be taken in a limiting sense, but is meant only to illustrate the general principles of the invention. Various inventive features are described below that can each be used independently or in combination.

Figure 1:
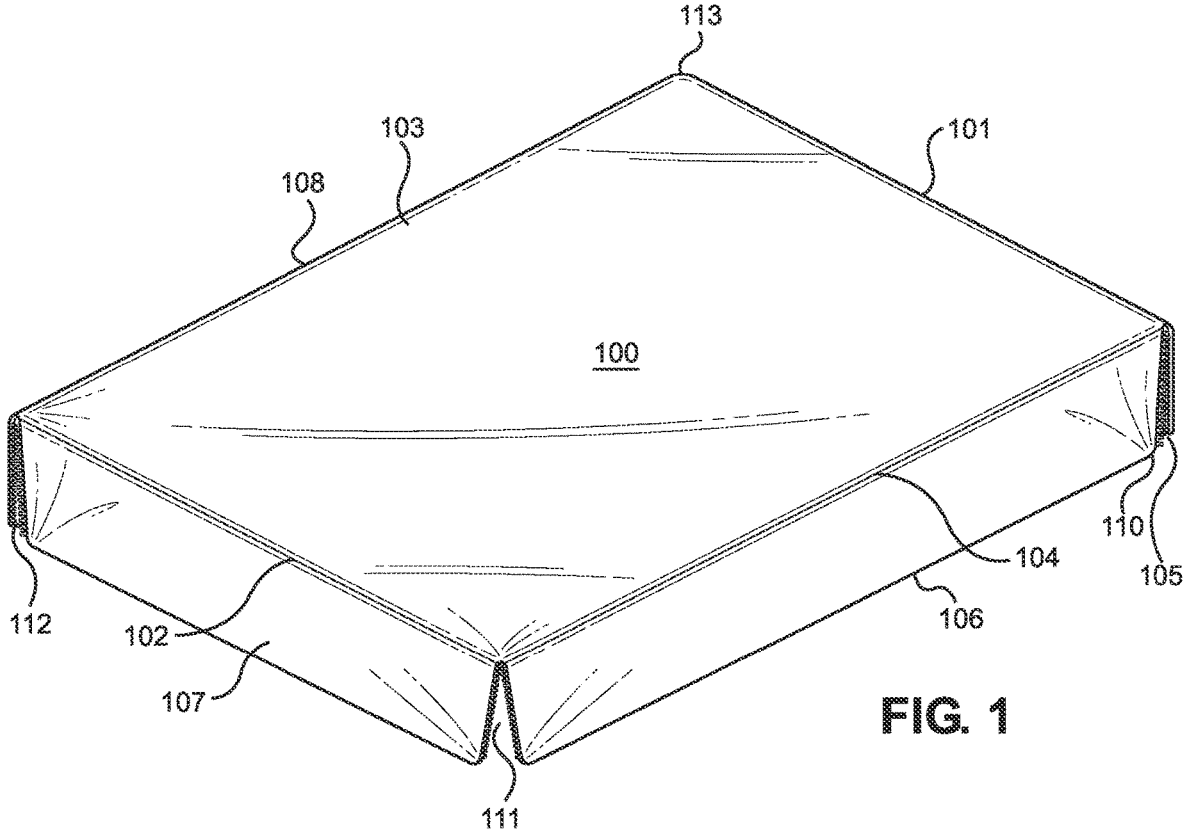
FIG. 1 is a perspective view of one embodiment of the fitted bed sheet of the invention in its open configuration.
Figure 8:
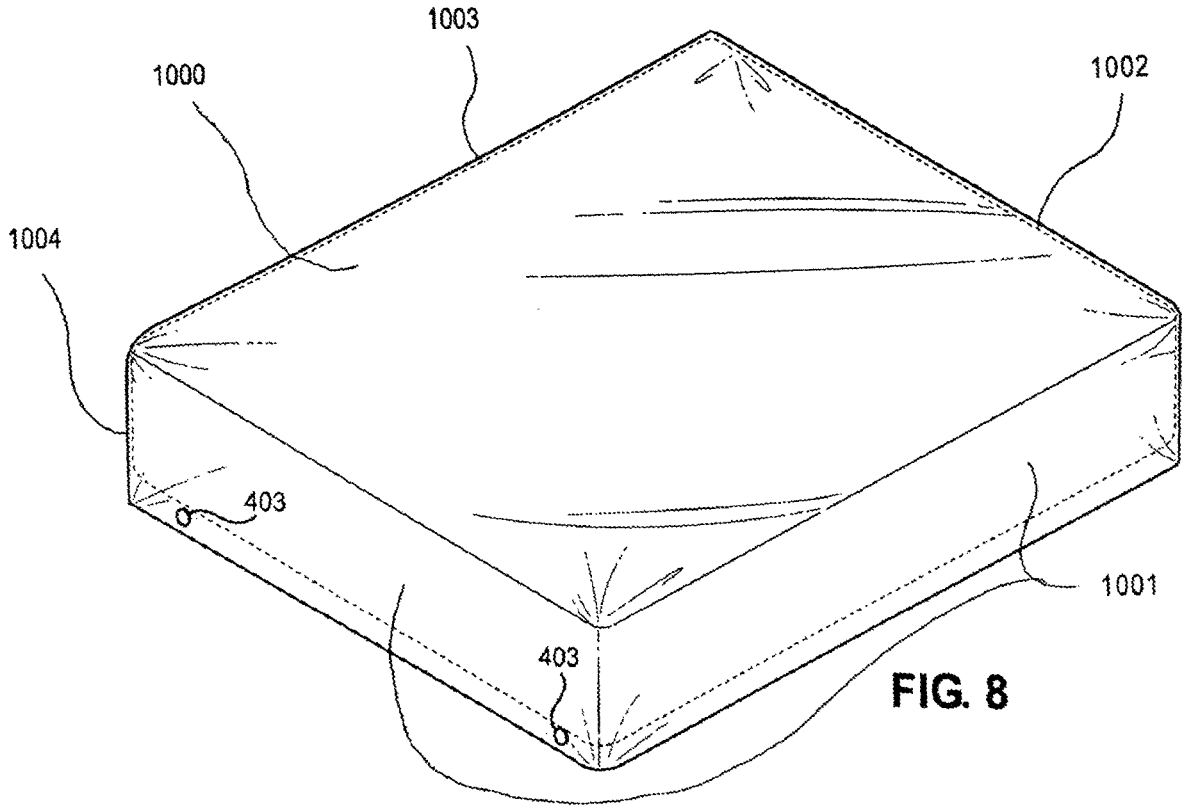
FIG. 8 is a perspective view of one embodiment of the fitted sheet and duvet cover of the invention applied to a mattress.

The invention may be understood by reference to the drawings. FIG. 1 is a representation of a fitted sheet 100. The fitted sheet 100 has a horizontal component with four top edges, 101, 102, 103, and 104 and four flaps 105, 106, 107, and 108 that fold down over the vertical faces (FIG. 8, 1001) of a mattress (FIG. 8, 1000). The fitted sheet 100 may be comprised of a single piece of fabric in which case the edges are defined only by the folding of the flaps down over the vertical surfaces 1001 of the mattress 1000. Alternatively, the flaps may be separate pieces of fabric sewn to the horizontal component of the fitted sheet 100 in which case the top edges are formed by the seam between the horizontal component and the flaps. The flaps connect to the adjacent flaps along their short edges. In one embodiment, the connections between all four flaps are made by way of connection means 110, 111, 112, and 113. In another embodiment, two of the flaps such as 105 and 108 may be connected to each other permanently, such as by a sewn seam while the connections between the remaining flaps such as 105-106, 106-107, and 107-108 may be made by connection means 110, 111, and 112, respectively. In another embodiment, two pairs of flaps such as 105-108 and 105-106 may be connected to each other permanently such as by a sewn seam while the connections between the remaining flaps such as 106-107 and 107-108 may be made by connection means, such as 111 and 112, respectively. In another embodiment, three pairs of flaps such as 105-108, 105-106, and 107-108 may be connected to each other permanently such as by a sewn seam while the connection between remaining pair of flaps such as 106-107 may be made by connection means such as 111. Connection means 110, 111, 112, and 113 may be any means of temporarily, but securely, connecting two pieces of fabric, including, but not limited to zippers, hook and loop fasteners, snaps, buttons, or other mechanical fasteners.

Figure 2:
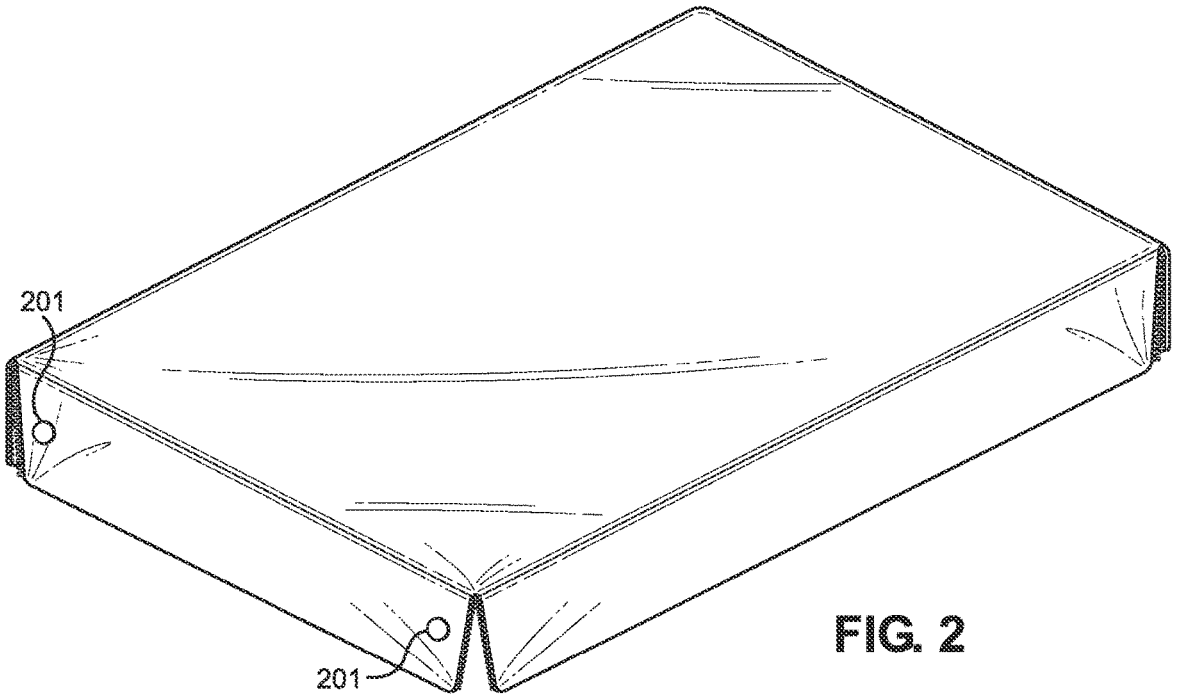
FIG. 2 is a perspective view of one embodiment of the fitted bed sheet of the invention in its open configuration.

FIG. 2 showing the fitted sheet 100 in the open configuration further shows first alignment means 201 on flap 107, which in this embodiment represents the flap at the "foot" end of the mattress 1000. In one embodiment, two first alignment means 201 are located near the short edges of flap 107. In another embodiment, two first alignment means 201 are located on flap 107, but not near the short edges of the flap. In another embodiment, more than two first alignment means 201 are located throughout the flap 107. In one embodiment, all of first alignment means 201 are magnets. In another embodiment, all of first alignment means 201 are thin pieces of ferrous metal. In another embodiment, some of first alignment means 201 are magnets and other first alignment means 201 are thin pieces of ferrous metal.

Figure 3:
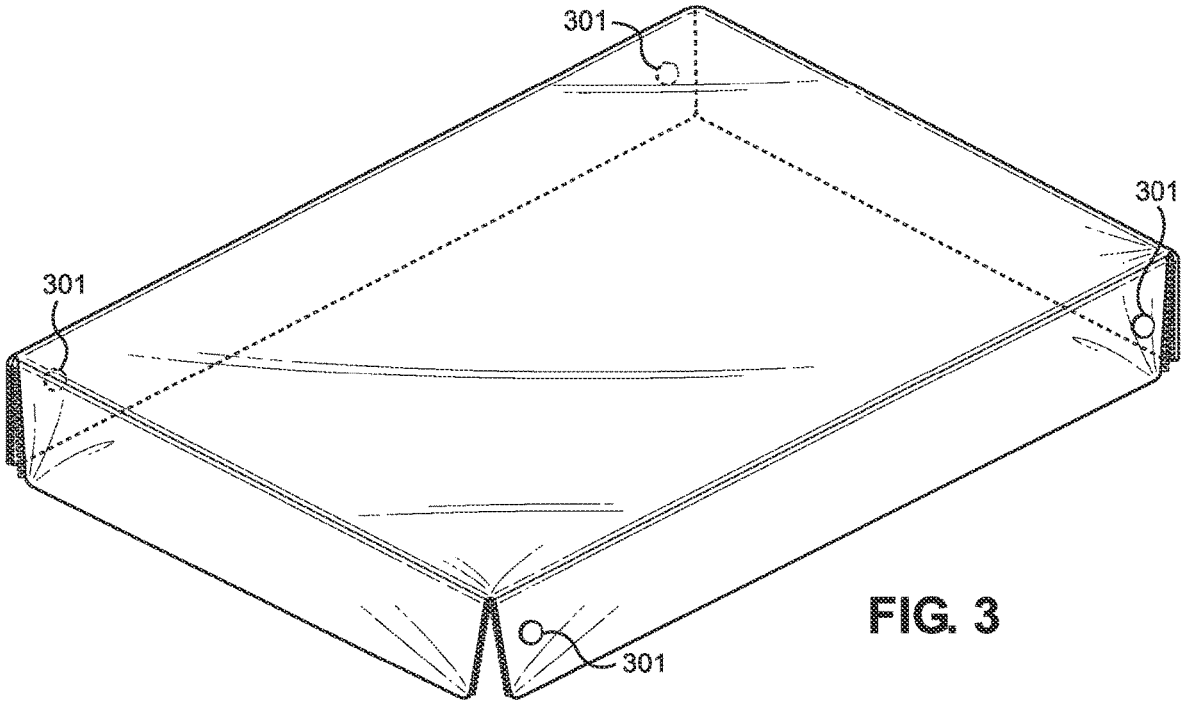
FIG. 3 is a perspective view of one embodiment of the fitted bed sheet of the invention in its open configuration.

FIG. 3 showing the fitted sheet 100 in the open configuration further shows first alignment means 301 on flaps 106 and 108, which in this embodiment represent the flaps on the sides 1001 of the mattress 1000, adjacent to the "foot" and "head" ends of the mattress 1000. First alignment means 301 may be located at least near the short edges of flaps 106 and 108, but may also be located in additional locations throughout flaps 106 and 108. Optionally, the fitted sheet 100 may include the first alignment means 201 of flap 107 and the first alignment means 301 of flaps 106 and 108. In one embodiment, all of first alignment means 301 are magnets. In another embodiment, all of first alignment means 301 are thin pieces of ferrous metal. In another embodiment, some of first alignment means 301 are magnets and other first alignment means 301 are thin pieces of ferrous metal.

Figure 4:
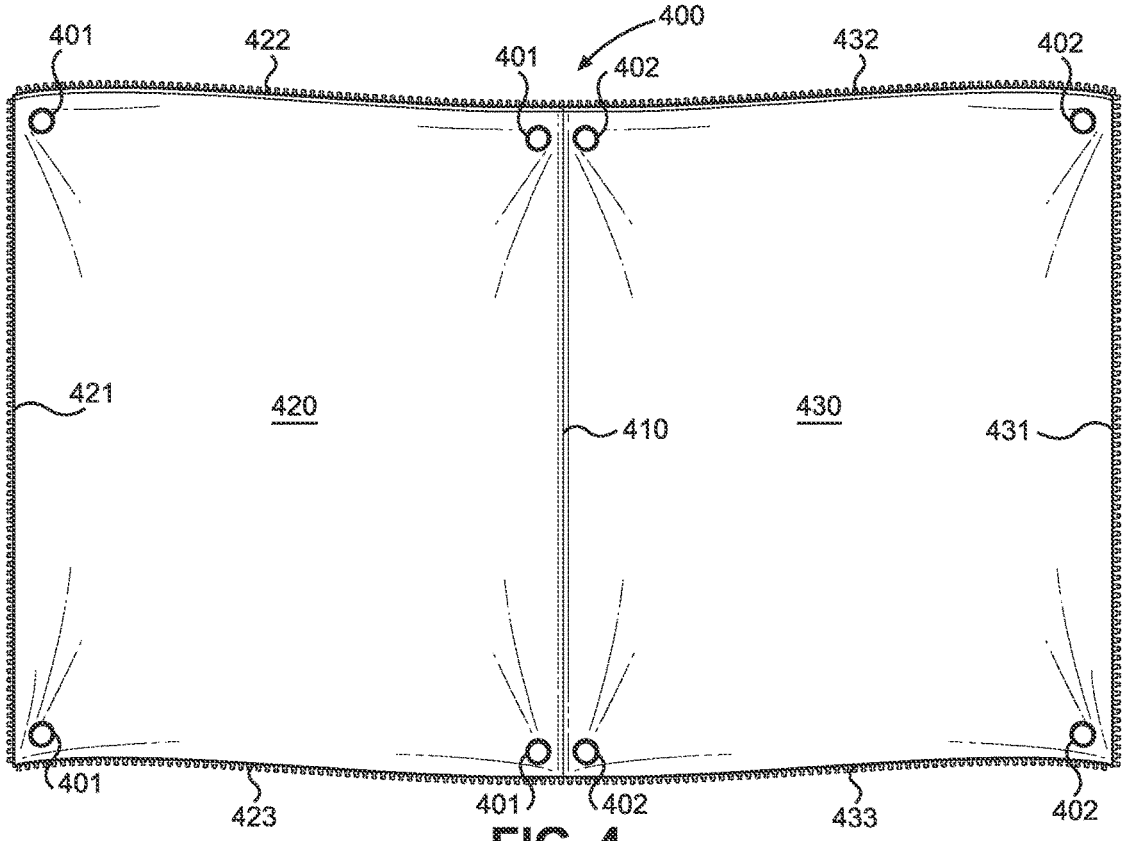
FIG. 4 is a perspective view of one embodiment of the duvet cover of the invention in its open configuration without a duvet inserted, in which the top and bottom halves of the duvet cover are connected along one edge.

FIG. 4 shows the duvet cover 400 of the invention in an open configuration showing the interior surface of the duvet cover 400 without a duvet inserted. The duvet cover is divided into two halves, the top half 420 and the bottom half 430. The duvet cover 400 may be comprised of two separate sections that are permanently affixed along one edge, such as by a sewn seam represented by edge 410. In an alternative embodiment, the entire duvet cover 400 may be comprised of a single section that is folded in half to enclose the duvet, in which case, the folded edge is represented by edge 410.

The top half 420 further comprises a plurality of second alignment means 401. In one embodiment, four second alignment means 401 are located near the corners of top half 420. In another embodiment, two second alignment means 401 are located near edge 421 and two second alignment means 401 are located near edge 410. In another embodiment, two second alignment means 401 are located near edge 423 and two second alignment means are located near the corners of edges 421-422 and 422-410. In another embodiment, more than four second alignment means may be located in additional locations throughout the top half 420. The bottom half 430 comprises a plurality of third alignment means 402. The third alignment means 402 are located in positions such that when the duvet cover is folded along edge 410, they connect with second alignment means 401 on the top half 420 and edge 421 is aligned with edge 431, edge 422 is aligned with edge 432, and edge 423 is aligned with edge 433. In one embodiment all of second alignment means 401 are magnets. In another embodiment all of second alignment means 401 are thin pieces of ferrous metal. In another embodiment some of second alignment means 401 are magnets and others are thin pieces of ferrous metal. In one embodiment all of third alignment means 402 are magnets. In another embodiment all of third alignment means 402 are thin pieces of ferrous metal. In another embodiment some of third alignment means 402 are magnets and others are thin pieces of ferrous metal.

Figure 5:
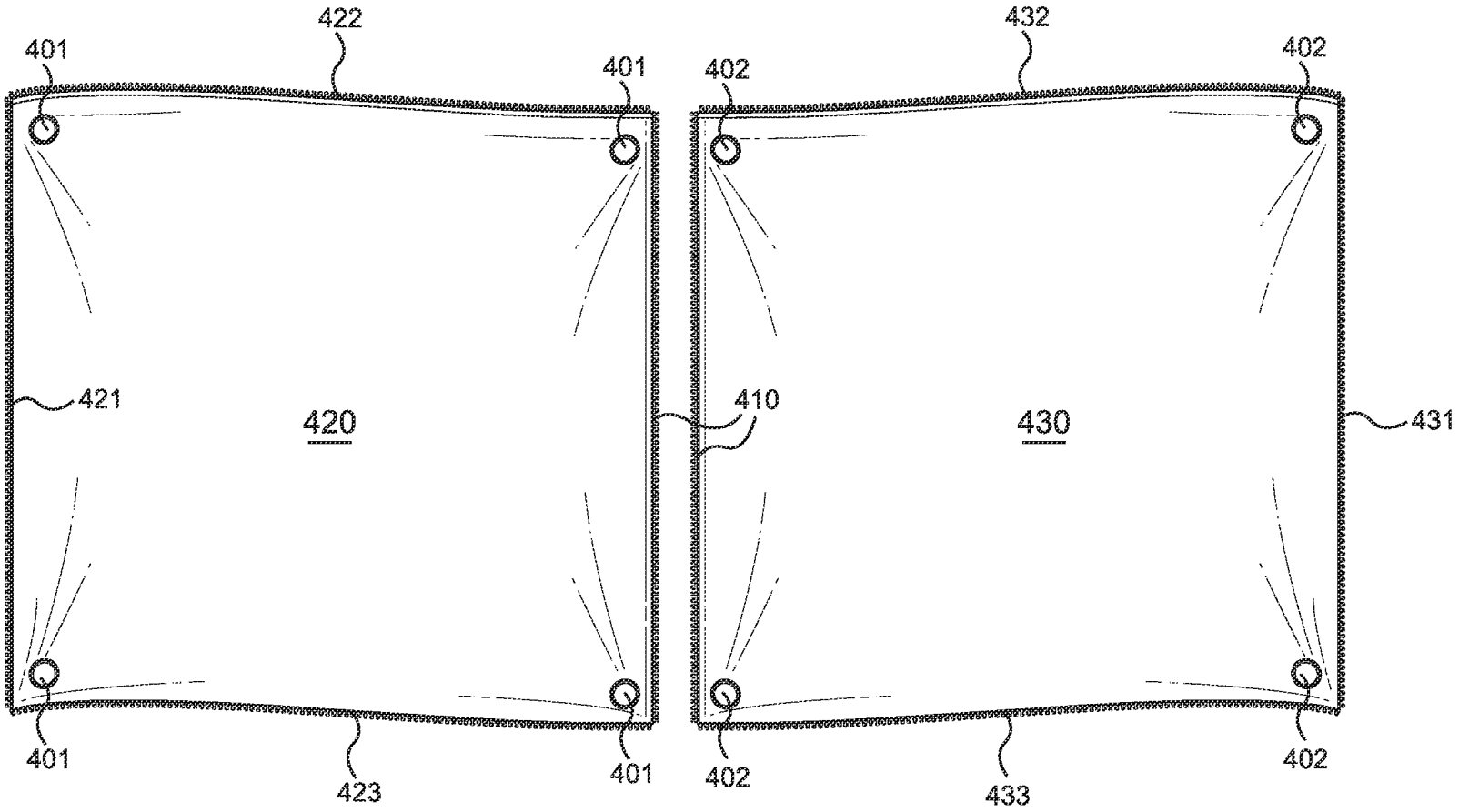
FIG. 5 is a perspective view of one embodiment of the duvet cover of the invention in an open configuration without a duvet inserted, in which the top and bottom halves of the duvet cover are separate.

FIG. 5 shows another embodiment of the duvet cover 400 of the invention in which the top half 420 and the bottom half 430 are separated into different pieces that can be reattached after insertion of a duvet.

Figure 6:
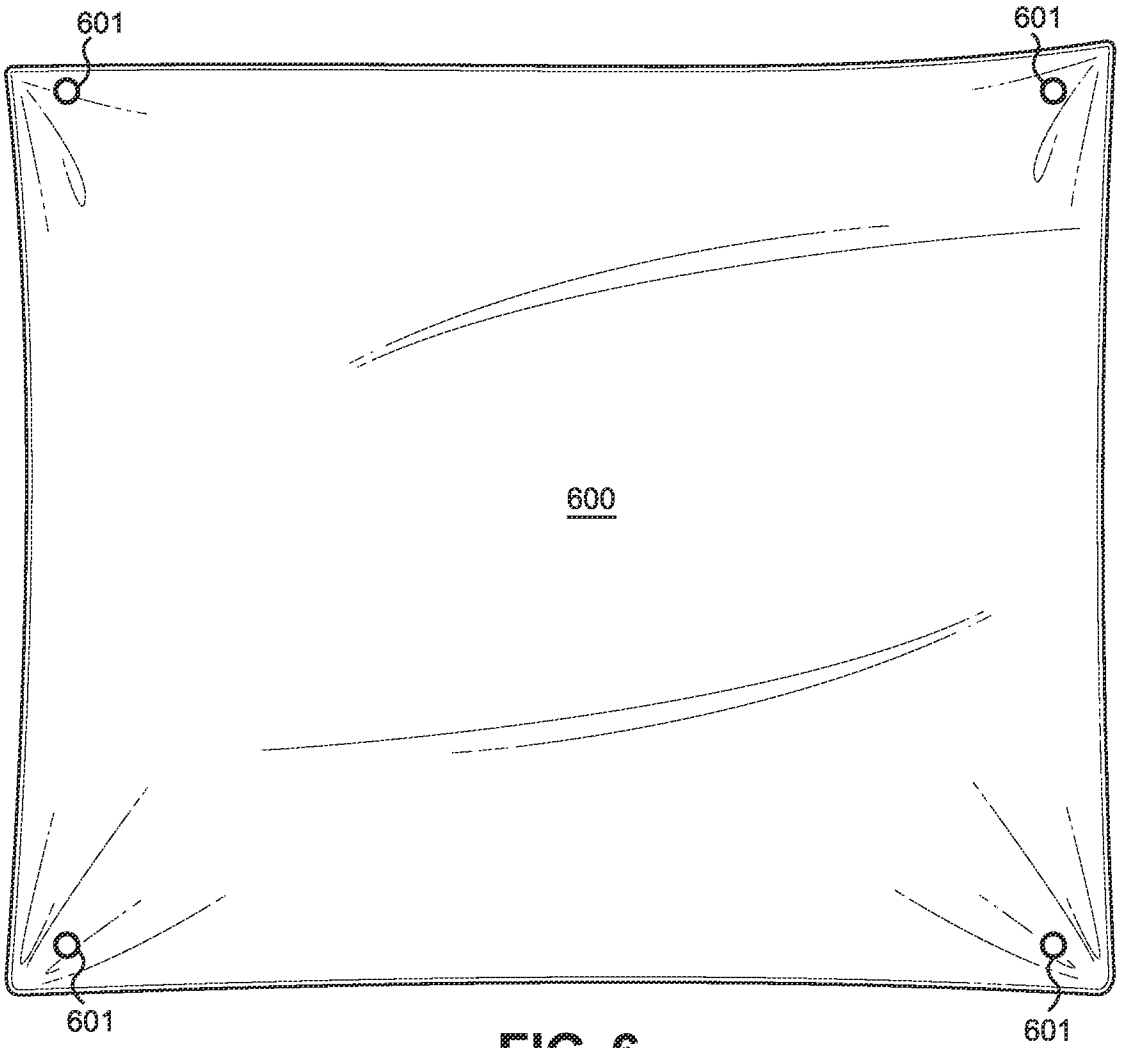
FIG. 6 is a perspective view of one embodiment of the duvet of the invention.

FIG. 6 shows a duvet 600 comprising a plurality of fourth alignment means 601. Fourth alignment means 601 are located in positions such that when the duvet 600 is inserted into the duvet cover 400 they connect with second alignment means 401 of the top half 420 on one side and third alignment means 402 of bottom half 430 on the other side in such a way that the duvet is approximately flat and edge 610 is approximately parallel to and just inside edge 410 of the duvet cover 400, edge 611 is approximately parallel to and just inside edges 421 and 431, edge 612 is approximately parallel to and just inside edges 422 and 432, and edge 613 is approximately parallel to and just inside edges 423 and 433. In one embodiment all of fourth alignment means 601 are magnets. In another embodiment all of fourth alignment means 601 are thin pieces of ferrous metal. In another embodiment some of fourth alignment means 601 are magnets and others are thin pieces of ferrous metal.

In the embodiment depicted in FIG. 4, the duvet cover 400 is opened like a book to reveal the inside surfaces of top half 420 and bottom half 430. The duvet 600 is laid onto the bottom half 430 aligning the third alignment means 402 and fourth alignment means 601. The duvet cover is then folded along edge 410 to lay the top half on top of the combination of the duvet 600 and the bottom half 430, aligning second alignment means 401 with fourth alignment means 601. The duvet cover is then closed by securing edges 421 to 431, 422 to 432, and 423 to 433 by means of one or more closing means, such as zippers, hook and loop fasteners, buttons, or snaps. In one embodiment, a zipper may begin at the corner of edges 410 and 432 and may zip along edges 422 and 432 to the edges of 421 and 431 to the edges of 423 and 433, ending at the corner of edges 410 and 433. Alternatively, a zipper may begin at the corner of edges 410 and 433 and proceed in the opposite direction. In another embodiment, one zipper may begin at the corner of edges 410 and 432 and another may begin at the corner of edges 410 and 433 and they meet along edges 421 and 431. The combination of alignment means 401 to 601 to 402 allows the user to easily secure the duvet in position so that it does not shift, fold, or bunch inside the duvet cover, yielding a smoother appearance and a more comfortable experience for the user.

In the embodiment shown in FIG. 5, the bottom half 430 is laid approximately flat with the interior surface facing up. The duvet 600 is placed on top of the bottom half with fourth alignment means 601 engaging with third alignment means 402 as described above. The top half 420 is then placed on top of the combination of duvet 600 and bottom half 430, with second alignment means 401 engaging with fourth alignment means 601 as described above. The top half 420 is then secured to the bottom half 430 by means of one or more zippers.

The top half 420 and bottom half 430 of the duvet cover 400 as well as the duvet 600 may each be comprised of a single layer of fabric, multiple layers of fabric, or multiple layers of fabric with filler material, such as down, polyester, or other suitable material between the fabric layers. In embodiments where the duvet cover and/or the duvet are comprised of multiple layers, the alignment means 401, 402, and 601 may be placed between fabric layers. Alternatively, the alignment means 401, 402, and 601 may be secured in place by use of fabric pockets sewn onto the interior surface of the duvet cover 400 and/or the outer surface of the duvet 600.

In embodiments in which any of alignment means 201, 301, 401, 402, 403, 601, or 901 are comprised of thin pieces of ferrous metal, such pieces may be encased in thin layers of plastic or may be coated with paints, lacquers, and/or other known means to seal the material and prevent rusting.

Figure 7:
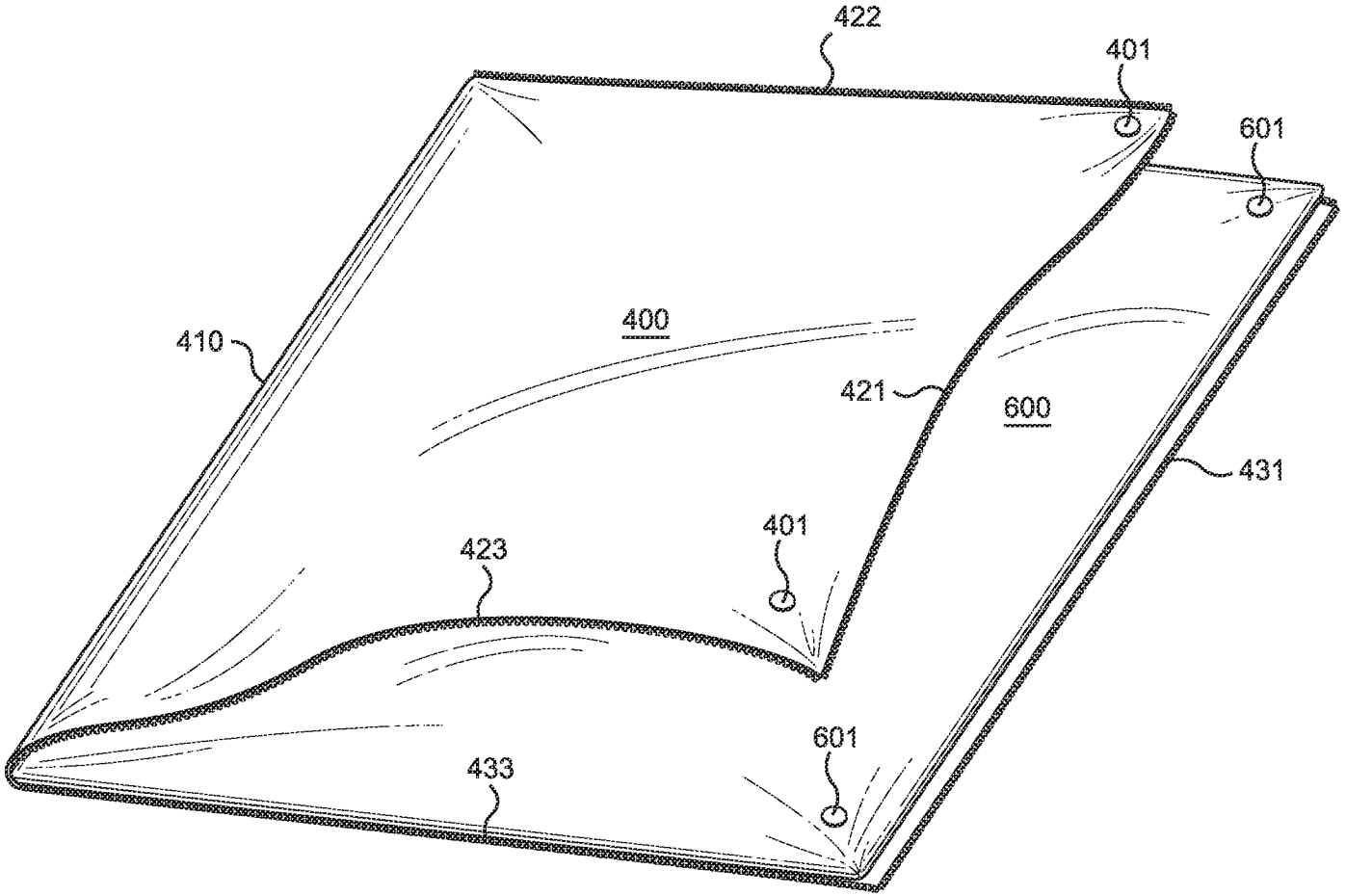
FIG. 7 is a perspective view of one embodiment of the duvet cover of the invention in a partially open configuration with a duvet inserted.

FIG. 7 shows the duvet 600 inserted into the duvet cover 400 in a partially closed configuration.

FIG. 8 shows the duvet cover as used on top of a mattress 1000. The mattress has four vertical surfaces 1001, two short edges 1002, two long edges 1003, and four vertical edges 1004. Alignment means are used both to secure the duvet cover to the fitted sheet and to align the duvet cover so it is centered on the mattress 1000. In one embodiment, the third alignment means 402 of the duvet cover connect with the first alignment means 201 of FIG. 2. In another embodiment, the third alignment means 402 of the duvet cover connect with the first alignment means 301 of FIG. 3. In another embodiment, the bottom half 430 of the duvet cover comprises a set of third alignment means 403 that are separate from the third alignment means 402 used to attach the duvet. These third alignment means 403 may connect with first alignment means 201 and/or 301 of the fitted sheet.

In one embodiment, a user may place the duvet cover 400 on top of the mattress 1000, connecting the third alignment means 402 along edge 431 with the first alignment means 301 along edge 106 of the fitted sheet 100. The duvet cover is then pulled across the bed mattress 1000 and the third alignment means 402 along edge 410 are connected with the first alignment means 301 along edge 108 of the fitted sheet. The top edge 422/432 of the duvet cover 400 is then folded down and pillows placed over the folded edge to complete the making of the bed.

Figure 9:
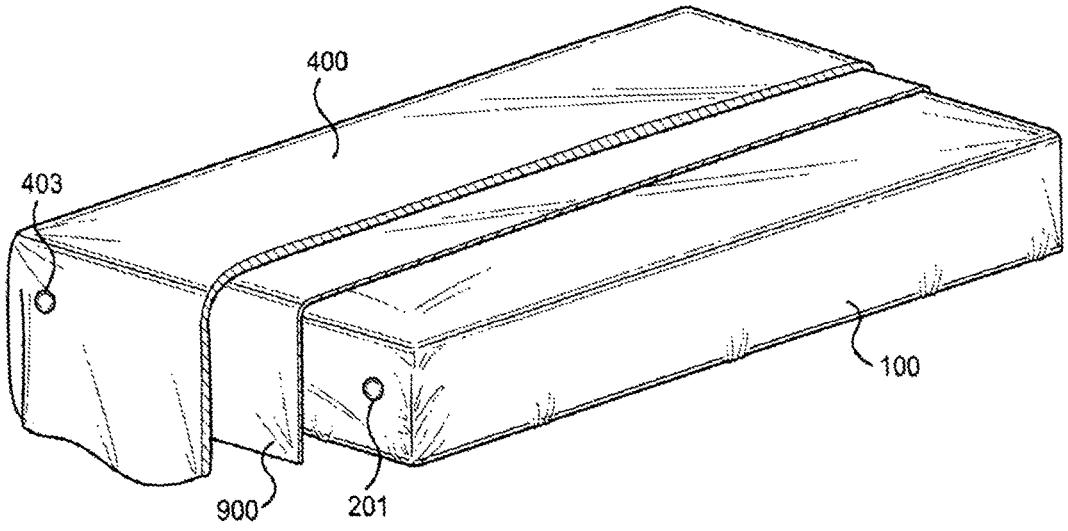
FIG. 9 is a perspective view of one embodiment of the fitted sheet, flat sheet, and duvet cover of the invention applied to a mattress.

FIG. 9 shows a flat sheet 900 may be placed between the fitted sheet 100 and the duvet cover 400. In one embodiment, the flat sheet 900 is secured in place by being clamped between the first alignment means 201 and/or 301 of the fitted sheet and the third alignment means 402 and/or 403 of the duvet cover. In another embodiment, the flat sheet 900 comprises a plurality of fifth alignment means 901 that connect with the first alignment means 201 and/or 301 of fitted sheet 100. In one embodiment all of fifth alignment means 901 are magnets. In another embodiment all of fifth alignment means 901 are thin pieces of ferrous metal. In another embodiment some of fifth alignment means 901 are magnets and others are thin pieces of ferrous metal.

Figure 10:
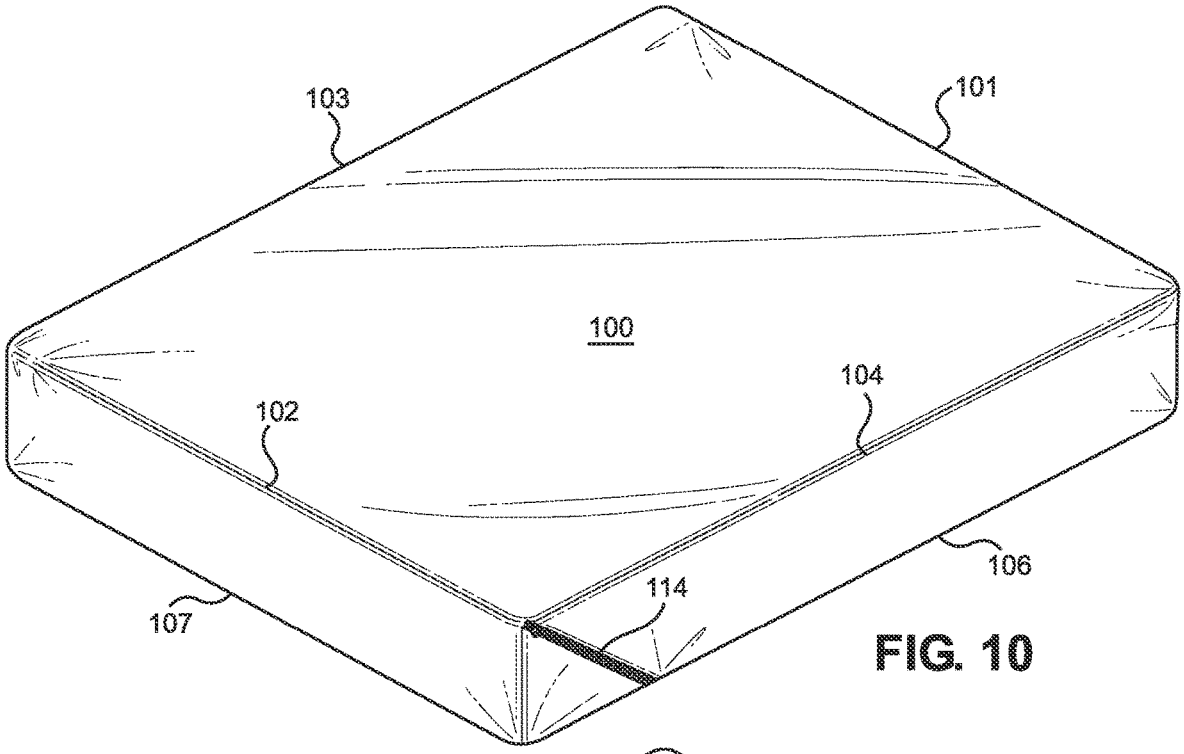
FIG. 10 is a perspective view of one embodiment of the fitted sheet of the invention in its closed configuration.

FIG. 10 represents an alternative embodiment of the fitted bottom sheet 100 in which the tabs to be secured together by connection means 114 are shaped such that the joined edges of the tabs do not correspond to the vertical edges 1004 of the mattress 1000, but rather begin from one corner of the vertical edge 1004 of the mattress 1000 and proceed at an angle away from the vertical edge. This configuration of an angled connection means may occur only on one corner as shown in FIG. 10, or may occur at one, two, three, or all four corners of the fitted sheet 100. The connection means may comprise any known means for securing fabric, such as a zipper, hook and loop fastener, snaps, buttons, or other known means.

Figure 11:
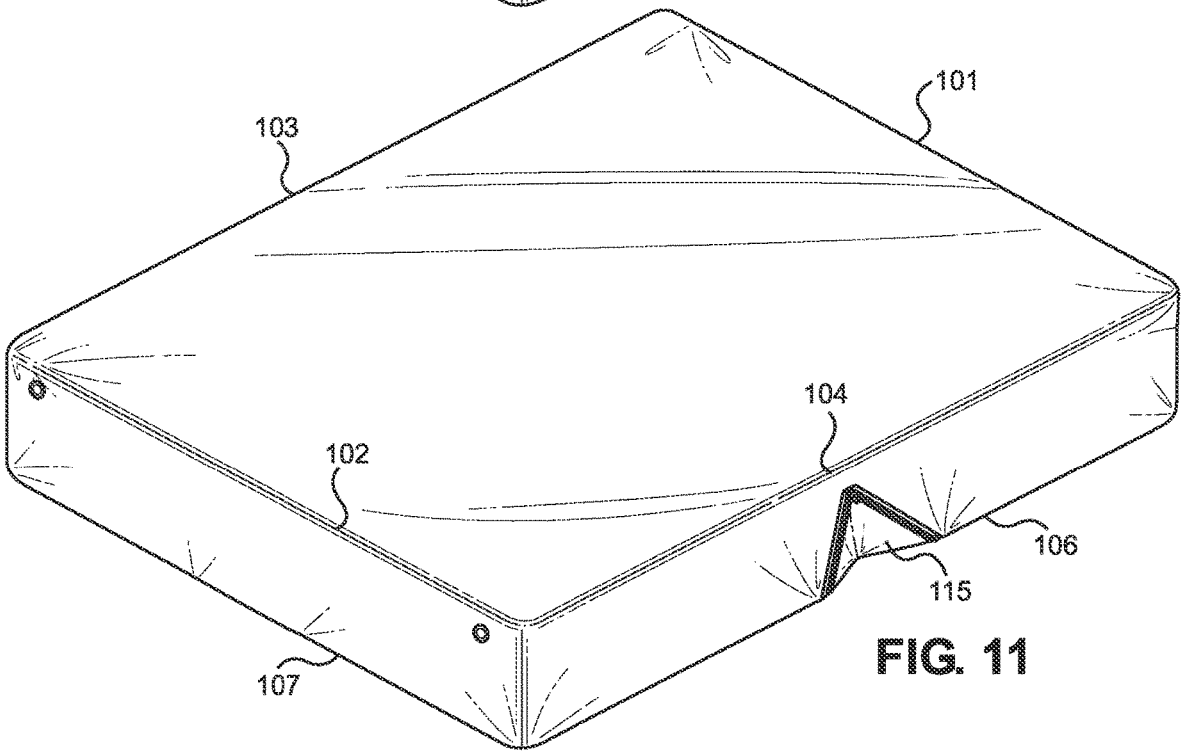
FIG. 11 is a perspective view of one embodiment of the fitted sheet of the invention in its open configuration.

FIG. 11 represents an alternative embodiment of the fitted bottom sheet 100 in which the connection means 115 are located on the long edge of one or more flaps, rather than on the short edges of adjoining flaps. Optionally, as shown in FIG. 11, the flap may contain a gusset behind the connection means. The connection means may comprise any known means for securing fabric, such as a zipper, hook and loop fastener, snaps, buttons, or other known means.

Figure 12:
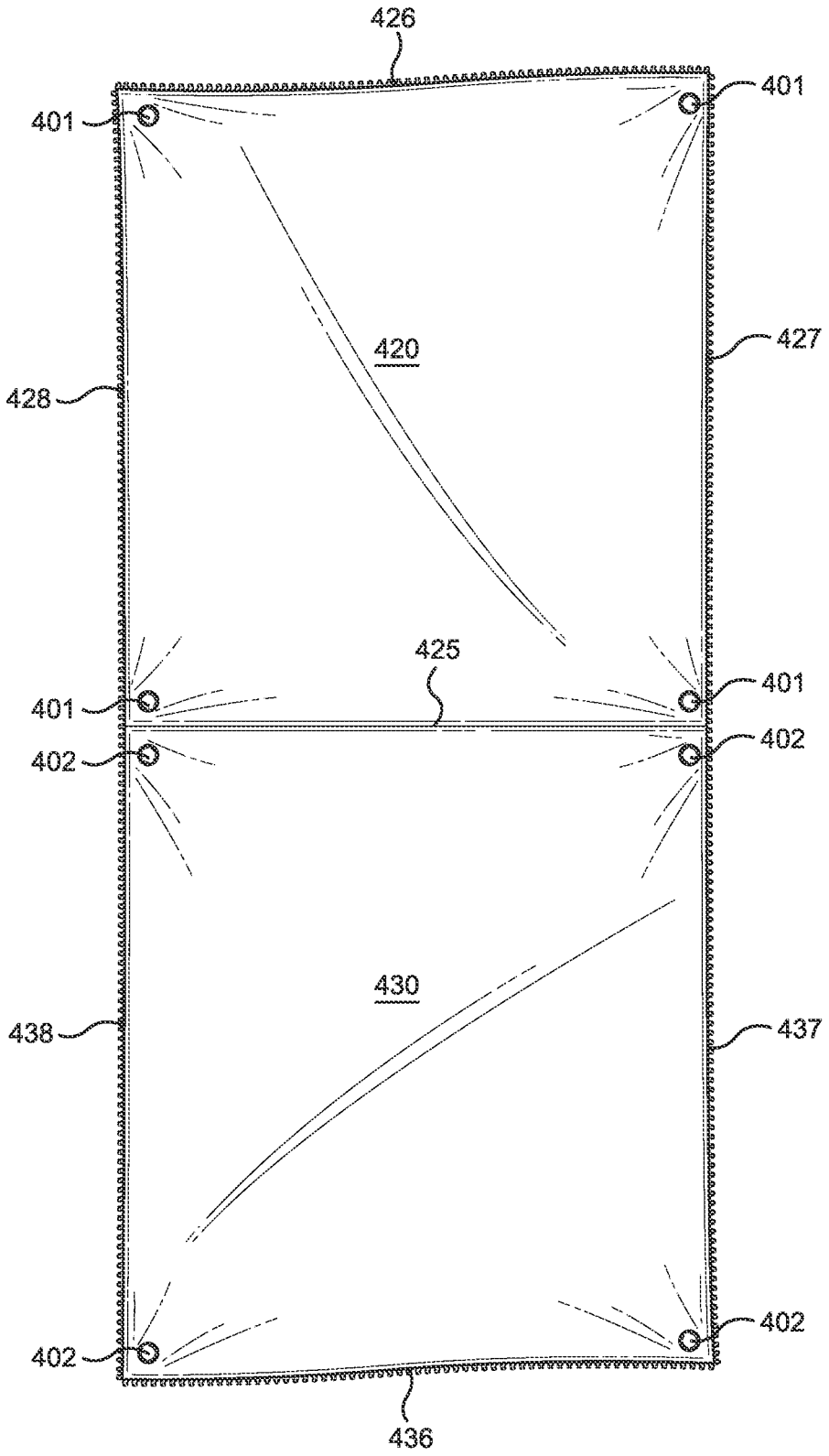
FIG. 12 is a perspective view of one embodiment of the duvet cover of the invention in its open configuration without a duvet inserted, in which the top and bottom halves of the duvet cover are connected along the edge at the head end of the mattress.

In the embodiment depicted in FIG. 12, the duvet cover 400 is opened like a notepad to reveal the inside surfaces of top half 420 and bottom half 430. The duvet 600 is laid onto the bottom half 430 aligning the third alignment means 402 and fourth alignment means 601. The duvet cover is then folded along edge 425 to lay the top half on top of the combination of the duvet 600 and the bottom half 430, aligning second alignment means 401 with fourth alignment means 601. The duvet cover is then closed by securing edges 427 to 437, 426 to 436, and 428 to 438 by means of one or more zippers. In one embodiment, a zipper may begin at the corner of edges 425 and 438 and may zip along edges 428 and 438 to the edges of 426 and 436 to the edges of 427 and 437, ending at the corner of edges 425 and 437. Alternatively, a zipper may begin at the corner of edges 425 and 437 and proceed in the opposite direction. In another embodiment, one zipper may begin at the corner of edges 425 and 438 and another may begin at the corner of edges 425 and 437 and they meet along edges 426 and 436. The combination of alignment means 401 to 601 to 402 allows the user to easily secure the duvet in position so that it does not shift, fold, or bunch inside the duvet cover, yielding a smoother appearance and a more comfortable experience for the user. In another embodiment, the duvet cover 400 may open with the top and bottom halves 420 and 430 connected at the foot end of the mattress. Having the connection at the head end, as shown in FIG. 12, however, has the added advantage of not having a zipper or other closing means on the edge in contact with the user.

While individually any one of alignment means 201, 301, 401, 402, 403, 601, or 901 may be comprised either of magnets or thin pieces of ferrous metal, one of ordinary skill in the art will recognize that in order to function as intended in this invention, for each point of connection between such alignment means, at least one alignment means must be a magnet. For example, in the connection between the duvet and the duvet cover, at each connection point where alignment means 401, 601, and 402 meet, at least one such alignment means must be a magnet, as if all three were ferrous metal, nothing would bind the alignment means together.

Modifications and variations in the construction and arrangement of the bedding system disclosed herein can be made without departing from the subject and spirit of the invention. For example, the number and placement of the various alignment means in the fitted sheet, flat sheet, duvet, and duvet cover may be altered. One of ordinary skill in the art would recognize that other configurations are possible and such modifications and variations are within the scope of the invention.

I claim:

1. A bedding system comprising: a fitted sheet comprising; a horizontal component with four top edges corresponding to the edges on the upper surface of a mattress, four flaps corresponding to the vertical surfaces of the mattress, wherein the short edges of said flaps connect to the short edges of adjacent flaps along the vertical edges of the mattress, and wherein a connection between the short edges of at least one pair of flaps is made by a connection means selected from the group consisting of zippers, snaps, buttons, and hook and loop fasteners; the fitted sheet further comprising a plurality of first alignment means, said first alignment means selected from the group consisting of magnets and thin pieces of ferrous metal; a duvet cover comprising a top half and a bottom half, said top half comprising a plurality of second alignment means and said bottom half comprising a plurality of third alignment means, said second alignment means and said third alignment means selected from the group consisting of magnets and thin pieces of ferrous metal; a duvet comprising one or more layers of fabric and sized to fit within the borders of the bottom half of the duvet cover; the duvet further comprising a plurality of fourth alignment means selected from the group consisting of magnets and thin pieces of ferrous metal; wherein said fourth alignment means are located in a manner to engage with the third alignment means when the duvet is placed on the bottom half of the duvet cover and to further engage with the second alignment means when the top half of the duvet cover is placed on top of the duvet; and wherein said first alignment means are located in a manner to engage with the third alignment means when the duvet cover is placed on top of the fitted sheet such that the duvet cover is centered on the mattress.

2. The bedding system of claim 1, further comprising a flat sheet disposed between the fitted sheet and the duvet cover.

3. The bedding system of claim 2, wherein the flat sheet comprises a plurality of fifth alignment means selected from the group consisting of magnets and thin pieces of ferrous metal, and wherein said fifth alignment means are located in a manner to engage with the first alignment means such that the flat sheet is centered on the mattress.

4. The bedding system of claim 1, wherein the first alignment means are located on the flap disposed on a foot-end of the mattress.

5. The bedding system of claim 1, wherein the first alignment means are located at a foot-end of the flaps disposed on the sides of the mattress.

6. The bedding system of claim 1, wherein the top half and bottom half of the duvet cover are connected along one edge and the remaining three edges comprise one or more closing means selected from the group consisting of zippers, hook and loop fasteners, buttons, and snaps.

7. The bedding system of claim 6, wherein the top half and bottom half of the duvet cover are connected along an edge corresponding to the head end of the mattress.

8. The bedding system of claim 1, wherein the top half and bottom half of the duvet cover are separate pieces that may be connected by closing means disposed on all four sides of the top half and bottom half, such closing means selected from the group consisting of zippers, hook and loop fasteners, buttons, and snaps.

9. The bedding system of claim 1, wherein the connection means between flaps begin from one corner of the vertical edge of the mattress and proceed at an angle away from the vertical edge.

* * * * *